US005147026A

United States Patent [19]

Scaglia

[11] Patent Number: 5,147,026

[45] Date of Patent: Sep. 15, 1992

[54] DEVICE TO TRANSFER ROVING PACKAGES WITH THE ROVING PRE-POSITIONED

[75] Inventor: Enzo Scaglia, Milan, Italy

[73] Assignee: Scaglia SpA, Brembilla, Italy

[21] Appl. No.: 540,277

[22] Filed: Jun. 19, 1990

[30] Foreign Application Priority Data

Jun. 30, 1989 [IT] Italy ..... 83447 A/89

[51] Int. Cl.[5] ..... B65G 47/24

[52] U.S. Cl. ..... 198/409; 198/468.2; 198/468.6; 198/345.1; 198/345.2; 57/281; 242/35.5 A

[58] Field of Search ..... 198/406, 409, 468.2, 198/468.6, 345.2, 345.3, 394, 395, 379, 345.1; 242/35.5 A; 57/281

[56] References Cited

U.S. PATENT DOCUMENTS

| | | | |
|---|---|---|---|
| 4,369,872 | 1/1983 | Sticht | 198/345.3 |
| 4,586,326 | 5/1986 | Igel | 57/281 |
| 4,735,042 | 4/1988 | Igel | 57/281 |
| 4,763,773 | 8/1988 | Kawarabashi et al. | 198/409 |
| 4,925,000 | 5/1990 | Pacakova et al. | 198/409 |
| 4,940,127 | 7/1990 | Kikuchi et al. | 242/35.5 A X |
| 4,944,146 | 7/1990 | Scaglia | 242/35.5 A |
| 5,082,192 | 1/1992 | Langen et al. | 198/409 |
| 5,096,357 | 3/1992 | Galbani | 242/35.5 A |

FOREIGN PATENT DOCUMENTS

| | | |
|---|---|---|
| 2637998 | 3/1977 | Fed. Rep. of Germany . |
| 3244925 | 6/1984 | Fed. Rep. of Germany . |
| 3332898 | 4/1985 | Fed. Rep. of Germany . |
| 8321639 | 9/1985 | Fed. Rep. of Germany . |
| 2129452 | 5/1984 | United Kingdom . |

*Primary Examiner*—Joseph E. Valenza

*Attorney, Agent, or Firm*—Antonelli, Terry, Stout & Kraus

[57] ABSTRACT

Device (10) to transfer roving packages with the roving pre-positioned, the packages (11) being taken from discharge means (23) belonging to or, in any event, connected to machines that prepare the roving for spinning, the packages (11) thereafter having to be positioned on conveyor means (26) which are advantageously automatic, to feed the creels of spinning machines, the device (10) comprising the following assemblies working in functional sequence:

a self-aligning assembly (37) which cooperates with the discharge means (23) and is suitable to position in a desired and pre-determined manner the packages (11) arriving at the end of the discharge means (23) and to withdraw the end of the roving from such packages (11) and to position that end on the package (11) itself in a desired manner, advantageously by placing the end on a frontal surface of the package, an arm (13) to engage and transfer the packages (11) which is suitable to cooperate with the self-aligning assembly (37) in engaging the packages (11) and transferring them onto support means (27–28) connected to the conveyor means (26), and an assembly (29) to clamp the support means (27–28) temporarily in a desired position so as to be enable the packages (11) to be transferred onto the support means (27–28) by the arm (13).

20 Claims, 2 Drawing Sheets

DEVICE TO TRANSFER ROVING PACKAGES WITH THE ROVING PRE-POSITIONED

BACKGROUND OF THE INVENTION

This invention concerns a device to transfer roving packages with the roving pre-positioned.

To be more exact, the invention concerns a device suitable to engage roving packages arriving from machines that prepare the roving for spinning and to transfer those packages, with the end of the roving suitably positioned, onto supports forming part of the systems to feed the roving packages to spinning machines.

The device is applied to the systems for automatic feed of roving packages to the creels of spinning machines; these systems carry out automatic replacement of empty packages on the creels.

The state of the art includes many methods and devices suitable to convey and replace roving packages on the creels of spinning machines.

The known embodiments have various degree of complexity and include proposals for working simplifications for the machine operatives and also proposals of a fully automated type.

These embodiments generally are very costly, are hard to operate and require great space in textile plants.

Moreover, the embodiments of the state of the art do not provide systems to seek and pre-position the end of the roving on packages intended to feed spinning machines.

SUMMARY OF THE INVENTION

The present applicant has the purpose of obtaining a simple, inexpensive and reliable device able to overcome the problems of the state of the art.

The invention is set forth in the main claim, while the dependent claims describe various features of the invention.

The device of the invention is suitable to cooperate with means that discharge the roving packages from machines which prepare the roving for spinning and which may be finisher boxes, fly frames or other machines which produce roving.

The discharge means in themselves may belong to these machines which prepare the roving for spinning, but may also be independent conveyors onto which the roving packages are discharged so as to be transferred.

The device of the invention cooperates also with automatic means that convey roving packages to feed the creels of spinning machines. These automatic conveyors means for the packages are advantageously but not only one or more overhead conveyors comprising supports, each of which bears one or more roving packages to feed the spinning machines.

The device can also be used to discharge from these supports the empty or almost empty tubes of the packages on the creels of the spinning machines when the creels are removed for replenishment with new roving packages.

In this case the device can also cooperate with storage points to collect empty or almost empty tubes.

The device of the invention consists of a structure to support and actuate an arm that engages the packages to be transferred as they arrive from the machines that prepare the roving packages.

This engagement arm is rotated in a vertical plane to take up firstly a position for cooperation with the packages to be transferred and thereafter a position for cooperation with the supports of the packages on the conveyor means that convey the packages to the spinning machines.

To work in either of these two positions the arm comprises means of its own which can be actuated in a momentarily extensible manner.

The arm can also be operated so as to work on various parallel vertical planes in sequence, the purpose of this being to be able to serve a plurality of positions for engagement and transfer of the roving packages.

In the position where the engagement arm cooperates with packages coming from the roving preparation machines, the device of the invention comprises self-alignment means which take and define one and the same three-dimensional position for the axis of each package, irrespective of the dimensions of the package.

The self-alignment means comprise also means to rotate each roving package about its own axis, these means cooperating with a system to aspirate and position the end of the roving subjected to aspiration.

When the engagement arm carries out removal of the package from the self-alignment means, the end of the roving, having a suitable length, takes up a desired position on the package automatically. This position is suitable for an easy subsequent engagement and extraction of the end of the roving by the spinning machine operatives.

When the engagement arm is in its position for cooperation with the package conveyor means, the device of the invention includes means to clamp each package support temporarily so as to enable the package to be transferred onto its own support.

These and other special features of this invention will be made clearer hereinafter in the description.

BRIEF DESCRIPTION OF THE DRAWINGS

The attached figures, which are given as a non-restrictive example, show the following.

DETAILED DESCRIPTION OF THE PREFERRED EMBODIMENT

Figure 2:
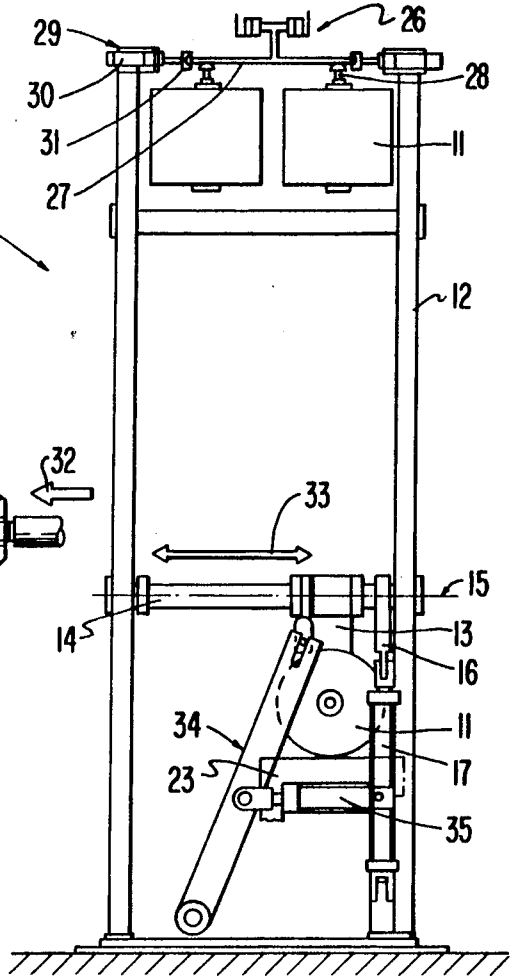
FIG. 2 gives a front view of the device of FIG. 1.
Figure 1:
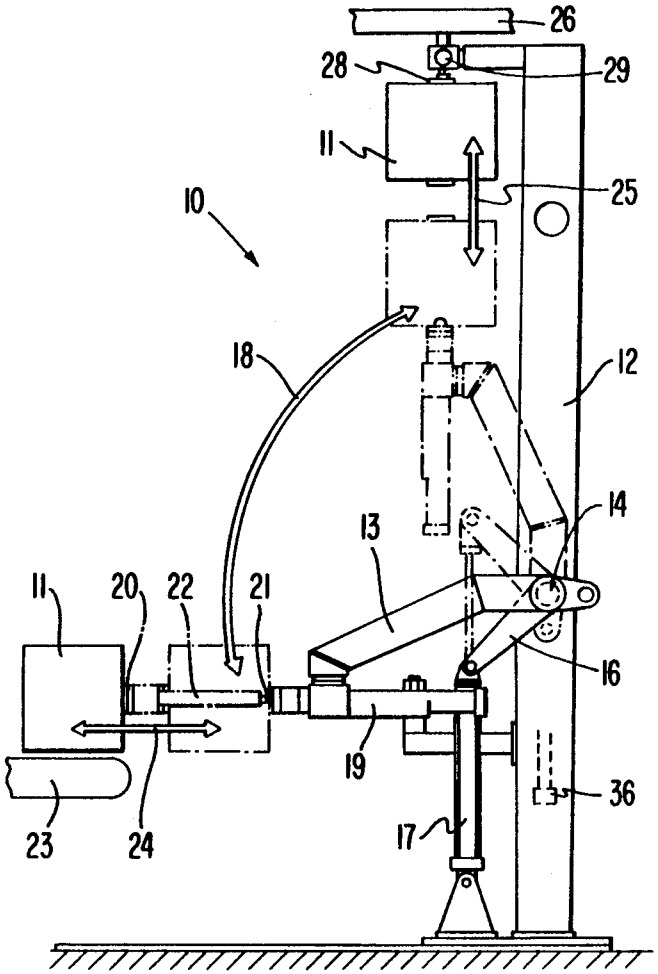
FIG. 1 gives a side view of the device of the invention.

A device 10 to transfer roving packages 11 is shown diagram-matically in FIGS. 1 and 2 and comprises a support structure 12 for an arm 13 that engages and transfers the packages 11.

This arm 13 is anchored to a shaft 14 supported by the structure 12 and can rotate about its axis 15 owing to the action of a lever 16 which is also anchored to the shaft 14.

The lever 16 is actuated by suitable actuation means, a first jack 17 in this example, so as to set the arm 13 in rotation according to the arrow 18 of FIG. 1 from one working position shown with full lines to another working position shown with lines of dashes.

The rotation according to this example correponds substantially to a right angle on a vertical plane.

The arm 13 bears at its end a momentarily extensible element, for instance a stem 22 of a second jack 19, which is caused to cooperate with a tube or small tube 20 of the roving package 11.

For this purpose the tip 21 of the stem 22 of the second jack 19 is conformed so as to be suitable for insertion, for instance, within the tube 20 and for expansion therein owing to the action of a fluid.

In any event this conformation and method of working form part of the state of the textile art.

The roving package 11 arrives on a discharge conveyor 23 belonging to a machine that prepares the roving for spinning or connected to machines of this type and is then engaged by the arm 13 according to the arrow 24 and is rotated according to the arrow 18.

In this position the second jack 19 is again actuated to transfer the package 11 according to the arrow 25 to a position for cooperation with an overhead system 26 to convey roving packages 11.

The travel of the stem 22 of the second jack 19 in this transfer is advantageously, but not only, equal to the travel carried out in taking the package 11 from the discharge conveyor 23.

The package conveyor system 26 consists generally of means to tow supports 27 of the packages 11. The supports 27 uphold the packages 11 by means of known pendular attachments 28 and each support can hold one or more packages 11, in this case two packages.

To perform the transfer of the packages 11 on the pendular attachments 28 correctly without mistakes, the device 10 includes an assembly 29 to clamp each support 27 temporarily whenever the support 27 is halted at its position for cooperation with the device 10.

Figure 3:
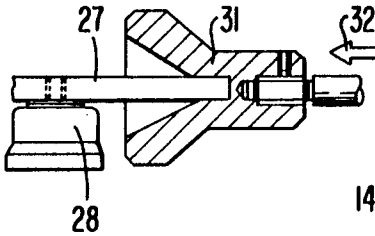
FIG. 3 shows a detail of the device of FIG. 1.

In this example (see also the detail of FIG. 3) the clamping assembly 29 consists of a pair of third jacks 30 which actuate momentarily jaws 31, connected to the third jacks 30, in the direction of the arrow 32 so as to clamp each package support 27 on both sides.

The arm 13 may be capable of a straight forward movement according to the arrow 33 and can slide on the shaft 14 through the actuation of a lever system 34 which can be actuated by a fourth jack 35, which is connected at 36 to the structure 12 of the device, for instance.

In this way the arm 13 itself can be brought into operation on different vertical planes, depending on the number of packages 11 per support 27 and/or on the number of discharge conveyors 23 to be served.

The arm 13 can be used also to discharge empty or almost empty tubes 20 from the pendular attachments 28 whenever the same overhead conveyor 26 or analogous conveyors are used to free the spinning machine creels when the feed packages are exhausted.

Clamping assemblies 29 are employed also and the arm 13 can cooperate thereafter with storage points of various types in depositing the empty or almost empty tubes 20.

Figure 5:
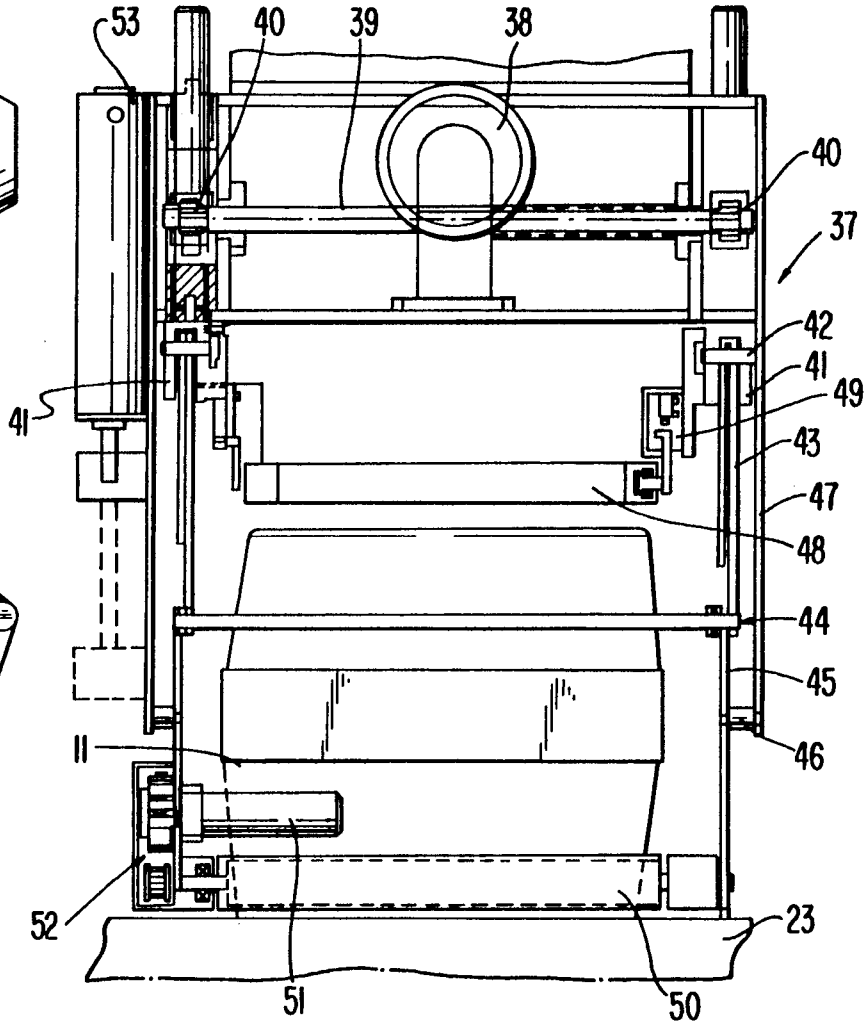
FIG. 5 is a side view of the self-alignment means of FIG. 4.
Figure 4:
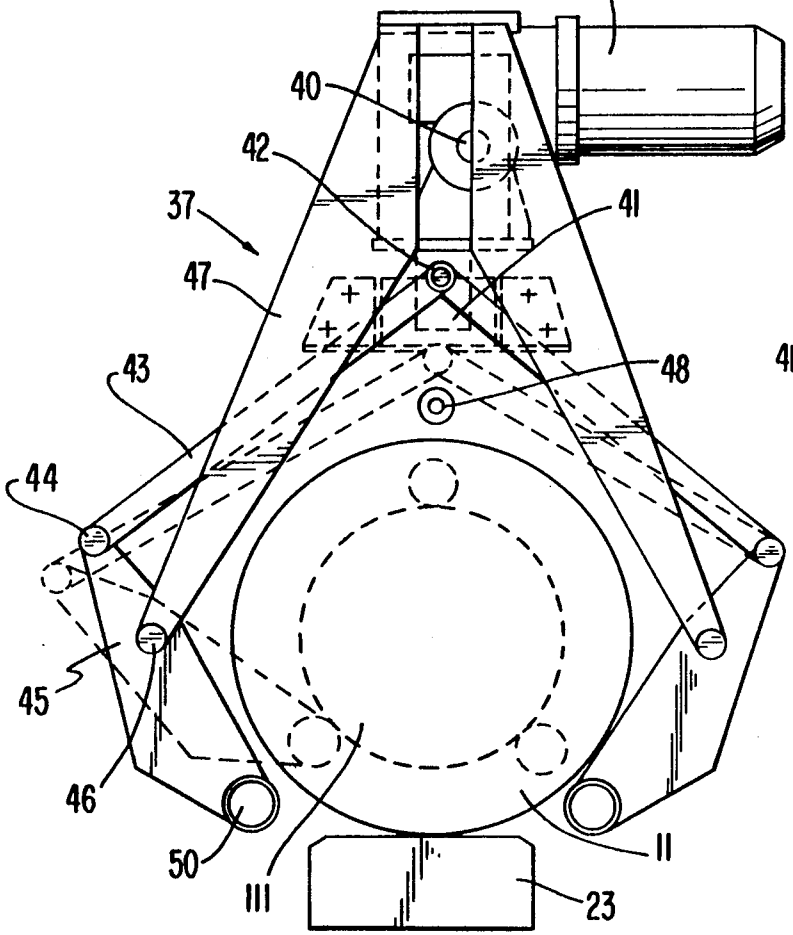
FIG. 4 shows a front diagrammatical view of the self-alignment means of the invention.

A self-alignment assembly 37 forming part of the device 10 cooperates with the terminal part of the discharge conveyor 23 and is shown in a frontal view in FIG. 4 and a side view in FIG. 5 in a simplified manner for reasons of clarity of explanation.

The self-alignment assembly 37 comprises a motor 38 to drive a shaft 39 that bears pinions 40 at its end. These pinions 40 cooperate with respective rack elements 41 on which are pivoted at 42 two oscillatory rods 43. Levers 45 are pivoted at the end 44 of the oscillatory rods 43 and are pivoted in turn at 46 on supporting uprights 47.

A roller conveyor 48, which oscillates by contact with the packages 11 and cooperates with an end-of-travel assembly 49 connected to the motor 38, is connected to the racks 41 and therefore to the oscillatory rods 43 and movable levers 45.

The levers 45 support roller elements 50 intended to cooperate with the packages 11 arriving in the vicinity of the terminal part of the discharge conveyor 23.

It is clear that cooperation between the rods 43, levers 45 and roller conveyor 48 enables the roving package 11 to be brought with its axis always in the same position, as required by the engagement arm 13, irrespective of the diameter of the package 11.

The lefthand portion of FIG. 4 shows with lines of dashes the position taken up by the assemblies mentioned above in the case of a package 111 having a small diameter.

The roller elements 50 are driven with a rotary motion by means of a motor 51 and transmission 52. This rotary motion serves to rotate the package 11 supported on the roller elements 50 during positioning of the axis of the package 11 by means of the self-alignment assembly 37.

The end of the roving is taken during the rotation, advantageously by aspiration, by means of a suitable aspiration means (not shown in the figure), which arranges also to position on the package itself 11 in a desired manner the end thus extracted.

The end of the roving is deposited advantageously on one of the frontal surfaces of the package 11 and is left hanging down on the lateral surface of the same 11 so that it can be reached easily by the spinning machine operatives.

FIG. 5 references with 53 an actuator means for a separator element intended to halt the packages 11, separated from each other, while they arrive in the neighbourhood of the terminal portion of the discharge conveyor 23.

We have described here a preferred embodiment of the device 10 according to the invention, but many variants are possible for a person skilled in this field without thereby departing from the scope of the invention as defined in the attached claims.

I claim:

1. Device to transfer packages of roving with the roving pre-positioned, the packages being taken from discharge means belonging to or, in any event, connected to machines that prepare the roving for spinning, the packages thereafter having to be positioned on conveyor means which are advantageously automatic, to feed creels of spinning machines, the device being characterized in that is comprises the following assemblies working in functional sequence:

a self-aligning assembly which cooperates with the discharge means and is suitable to position in a desired and pre-determined manner the packages arriving at the end of the discharge means, an arm to engage and transfer the packages which is suitable to cooperate with the self-aligning assembly in engaging the packages and transferring them onto support means connected to the conveyor means, and an assembly to clamp the support means temporarily in a desired position so as to enable the packages to be transferred onto the support means by the arm.

2. Device as claimed in claim 1, in which the self-aligning assembly comprises means to engage and position the packages and means to control the positioning, these engagement, positioning and control means being governed by their own actuation means.

3. Device as claimed in claim 1 in which the self-aligning assembly comprises actuation means to actuate means that halt and separate the packages on the discharge means.

4. Device as claimed in claim 1, in which the arm to engage and transfer the packages is movable at least in a vertical plane.

5. Device as claimed in claim 4, in which the arm is movable horizontally to enable the arm to operate in succession on a plurality of parallel vertical planes.

6. Device as claimed in claim 1, in which the arm comprises momentarily extensible means to engage packages.

7. Device as claimed in claim 6, in which the momentarily extensible engagement means are also means which transfer packages on at least one parallel plane.

8. Device as claimed in claim 6, in which the travel of the momentarily extensible engagement means is the same in the engagement of packages on the discharge means and in the transfer of packages onto the support means connected to the conveyor means.

9. Device as claimed in claim 6, in which the travel of the extensible engagement means in the engagement of packages on the discharge means and in the transfer of packages onto the support means is differentiated.

10. Device as claimed in claim 1, in which the assembly to clamp the support means temporarily comprises jaws that cooperate with the terminal parts of the supports of the packages.

11. Device as claimed in claim 10, in which the jaws are actuated functionally upon forward movement of the supports on the package conveyor system.

12. Device as claimed in claim 1, which cooperates with a plurality of discharge means.

13. Device as claimed in claim 1, which cooperates with package conveyor systems in the discharge of empty or almost empty tubes.

14. Device as claimed in claim 1, which cooperates with systems that store empty or almost empty tubes discharged from the package conveyor systems.

15. Device as claimed in claim 1, wherein said self-aligning assembly positions said end of said roving on a frontal surface of said package.

16. A device to transfer packages of roving from an end of discharge means operably connected to machines that prepare the roving for spinning to a conveyor which feeds creels of spinning machines, comprising:

self-aligning means for self-aligning and positioning said packages arriving at said end of said discharge means in a predetermined manner;

an arm cooperating with said self-aligning means for engaging said packages arriving from said end of said discharge means;

means for moving said arm in a vertical plane so as to transfer said packages to supports of said conveyor which feeds creels of spinning machines; and means for clamping said supports of said conveyor to enable said packages to be transferred thereto by said arm.

17. A device according to claim 16, further comprising means for positioning an end of each of said rovings from said package on a predetermined position on each of said packages.

18. A device according to claim 16, further comprising aspiration means for withdrawing an end of each of said rovings by aspiration from said package and positioning said end on a predetermined position on each of said packages.

19. Device as claimed in claim 1, further comprising aspiration means for withdrawing an end of the roving by aspiration from the packages and to position that end on a desired position of the package.

20. Device as claimed in claim 1, further comprising aspiration means for withdrawing an end of the roving by aspiration from the package and to position that end on a desired position of the package.

* * * * *